US006270940B2

(12) United States Patent
Goto

(10) Patent No.: US 6,270,940 B2
(45) **Date of Patent: *Aug. 7, 2001**

(54) LASER ABLATIVE RECORDING MATERIAL

(75) Inventor: Takahiro Goto, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/075,212

(22) Filed: May 11, 1998

(30) Foreign Application Priority Data

May 13, 1997 (JP) ..... 9-121911

(51) Int. Cl.[7] ..... B41M 5/26

(52) U.S. Cl. ..... 430/201; 430/945; 430/14; 430/270.18; 503/227

(58) Field of Search ..... 503/227; 430/445, 430/200, 201, 270.18

(56) References Cited

U.S. PATENT DOCUMENTS

| | | | | |
|---|---|---|---|---|
| 3,787,351 | * | 1/1974 | Olson | 523/453 |
| 4,755,432 | * | 7/1988 | Asaon et al. | 428/421 |
| 5,278,023 | * | 1/1994 | Bills et al. | 430/201 |
| 5,330,876 | | 7/1994 | Kaszczuk et al. | 430/200 |
| 5,387,496 | * | 2/1995 | DeBoer | 430/201 |
| 5,401,618 | | 3/1995 | Chapman et al. | 430/200 |
| 5,468,591 | * | 11/1995 | Pearce et al. | 430/201 |
| 5,529,884 | * | 6/1996 | Tutt et al. | 430/200 |
| 5,582,669 | * | 12/1996 | Gove et al. | 156/239 |
| 6,159,651 | * | 12/2000 | Ishihara et al. | 430/200 |

FOREIGN PATENT DOCUMENTS

| | | | | |
|---|---|---|---|---|
| 0602893 | * | 6/1994 | (EP) | 430/200 |
| 0698503 | * | 2/1996 | (EP) | 430/200 |
| 64-001589 | * | 1/1989 | (JP) . | |
| 10-114151 | * | 5/1998 | (JP) . | |
| 88/04237 | * | 6/1988 | (WO) | 430/200 |

OTHER PUBLICATIONS

Chemical Abstracts Index 1987–1991, p. 838G.*
McCutcheon's 1995, vol. 1: Emulsifiers and Detergents. pp 85–86.*

* cited by examiner

*Primary Examiner*—Martin Angebranndt
(74) *Attorney, Agent, or Firm*—Sughrue, Mion, Zinn, Macpeak & Seas, PLLC

(57) ABSTRACT

A laser ablative recording material having on a support a coloring agent layer containing a fluorine-containing surfactant, in which the fluorine-containing surfactant is a copolymer made of: (Condition I) either or both of acrylate having a fluoroaliphatic group and methacrylate having a fluoroaliphatic group (the fluoroaliphatic group herein includes 3 to 20 carbon atoms and fluorine atoms of 40% or more by weight where a half or above of atoms bonded to three carbon atoms constituting terminal portions are fluorine atoms.); and (Condition II) either or both of poly (oxyalkylene) acrylate and poly(oxyalkylene) methacrylate, wherein monomer units according to Condition I are 20 to 80 percent by weight of the copolymer is disclosed. This laser ablative recording material has features of a uniform surface state and a uniform film thickness profile, a small Dmin of the laser exposure portion, and smaller deviations in a maximum density.

18 Claims, No Drawings

LASER ABLATIVE RECORDING MATERIAL

BACKGROUND OF THE INVENTION

1. Field of the Invention

The present invention relates to a laser ablative recording material, and a laser ablative record of an image formed through imagewise heating of the laser ablative recording material.

2. Description of the Related Art

Recently, a thermal transfer system forming an image by imparting an electric signal to a thermal print head has become more popular. A method of forming an image by the use of a laser in place of the thermal print head was on the other hand developed, and is expected to become more popular along with the tendency toward a higher laser output.

A recording material for laser recording contains a material having a strong absorption in the laser wavelength region, and this absorbing material converts optical energy into thermal energy, and brings about effects similar to those available by the use of a thermal print head. Use of a laser, unlike the use of a thermal print head, permits heating without contact with a recording material, thus providing an advantage of the image surface free from flaws. Because of the possibility to stop down a laser beam, there is provided another advantage of improving image resolution.

A method for forming an image using a high-output laser known as the dye ablation has recently been developed. Japanese Unexamined Patent Publications Nos. 7-164,755, 7-149,063, and 7-149,065 (corresponding to U.S. Pat. No. 5,330,876, U.S. Pat. No. 5,401,618 and U.S. Pat. No. 5,459,017) disclose recording materials applicable in this method, and Japanese Unexamined Patent Publications Nos. 8-48,053 and 8-72,400 (corresponding to U.S. Pat. No. 5,521,629 and U.S. Pat. No. 5,574,493) disclose imaging apparatuses used in this method. Image recording based on the ablation method is accomplished by irradiating a laser from a dye layer side onto a recording material having a dye layer comprising an image dye, a material having absorption in the laser wavelength region (infrared-absorbing material) and a binder formed on a support. On the spot to which the laser beam has been irradiated, a sharp local change takes place in an image forming layer under the effect of energy from the laser, and this drives away the material from the layer. According to the aforesaid patent publications, this local change is not a perfectly physical change such as melting, evaporation or sublimation, but a kind of chemical change such as bond-breaking, and is believed to be a complete, not partial, removal of the image dye.

Usefulness of this dye ablation imaging method largely depends upon removal efficiency of the imaging dyes upon laser exposure. As a scale representing this efficiency, the minimum concentration value (Dmin) of the laser exposure portion is employed. A smaller value of Dmin is suggested to lead to a higher dye removing efficiency, and provision of a laser ablative recording material having a small Dmin is demanded for.

A recording material used for dye ablation imaging method is produced by applying and drying a material solved or dispersed in an organic solvent on a support such as polyethylene terephthalate or aluminum on which a surface is generally treated properly. Roller coating, wire doctor coating, etc. are used as a coating method. When a coating liquid of a low viscosity (about 10 cp or below) is applied, those methods raise problems that the dried surface becomes Benard Cells' state or the film thickness profile of the image forming layer becomes uneven due to temperature and humidity controlled air used during drying.

If a recording material with such unevenness defects is used as an output sensing material for a platemaking process, the unevenness on the recording material emerges as density unevenness when printed on a plate. When a recording material with unevenness defects is used as a printed plate, it causes deviations of printing durability. Laser ablative recording materials need particularly an even surface state and an even film thickness profile because a coloring agent at unexposed portions to laser beam creates a maximum density.

Meanwhile, fluorine-containing surfactants were recently found useful for specific usage. For example, Japanese Patent Publication (KOKOKU) No. Heisei 8-3,630 discloses fluorine-containing surfactants for photosensitive flat printing plates; Japanese Unexamined Patent Publication (KOKAI) sets forth use of fluorine-containing surfactants when a liquid of specific mixed solvents is coated with a coating die of a slide hopper type, extrusion type, or curtain hopper type. The specification of U.S. Pat. No. 5,380,644 sets forth use of fluorine-containing surfactants in photosensitive thermal sensitive materials containing organic silver salt or thermal sensitive materials. However, nothing describes use of fluorine-containing surfactants in laser ablation recording materials.

SUMMARY OF THE INVENTION

It is an object of the invention to provide a laser ablative recording medium having even surface state and even film thickness profile, a small minimum concentration value (Dmin) of the laser exposure portion, and no deviations in a maximum density. It is another object of the invention to provide a laser ablative recording medium having a high durability such as high resistance against light and resistance against humidity and heat. Objects of the invention other than the above objects may be understood by skilled person in this art from the entire description of the specification.

As a result of diligent researches intending to accomplish the above objects, the inventors found that a laser ablative recording material having a good surface state and a small Dmin can be made by using a specific fluorine-containing surfactant in a coloring agent layer and completed this invention.

That is, this invention is to provide a laser ablative recording material having on a support a coloring agent layer containing a fluorine-containing surfactant, in which the fluorine-containing surfactant is a copolymer made of: (Condition I) either or both of acrylate having a fluoroaliphatic group and methacrylate having a fluoroaliphatic group (the fluoroaliphatic group herein includes 3 to 20 carbon atoms and fluorine atoms of 40% or more by weight where a half or above of atoms bonded to three carbon atoms constituting terminal portions are fluorine atoms.); and (Condition II) either or both of poly(oxyalkylene) acrylate and poly(oxyalkylene) methacrylate, wherein monomer units according to Condition I are 20 to 80 percent by weight of the copolymer.

This invention also provides a laser ablative image-formed record prepared by irradiating a laser onto the laser ablative recording material.

DETAILED DESCRIPTION OF PREFERRED EMBODIMENTS

Hereinafter, the laser ablative recording materials of the invention and the laser ablative image-formed record will be described with regard to their constitution and preferred embodiments.

A fluorine-containing surfactant used for the ablative recording material according to the invention is a copolymer satisfying the following conditions of:

(Condition I) either or both of acrylate having a. fluoroaliphatic group and methacrylate having a fluoroaliphatic group (the fluoroaliphatic group herein includes 3 to 20 carbon atoms and fluorine atoms of 40% or more by weight where a half or above of atoms bonded to three carbon atoms constituting terminal portions are fluorine atoms.); and (Condition II) either or both of poly(oxyalkylene) acrylate and poly(oxyalkylene) methacrylate, wherein monomer units according to Condition I are 20 to 80 percent by weight of the copolymer.

As monomers according to Condition (1), monomers of one type can be used solely or monomers mixed with two or more types of monomers in an arbitrary proportion can used.

The fluoroaliphatic group Rf in the monomers according to Condition (1) is saturated aliphatic group, and in general, is monovalent. The fluoroaliphatic group may have a straight chain, branched chain, or circular structure (e.g., alkyl cycloaliphatic group). The skeleton chain of the fluoroaliphatic group Rf may be constituted of only carbon atoms and may include oxygen atoms and trivalent nitrogen atoms in the carbon chain. Those heteroatoms are stably bonded to fluorocarbon groups without raising reactivity of the inactive fluoroaliphatic group Rf excessively.

To effectuate this invention adequately, the number of carbon atoms in the fluoroaliphatic group Rf is preferably from 3 to 20 and, more preferably, from 6 to 12. The fluorine atoms bonded to a carbon atom are preferably 40% or more by weight and, more preferably, 50% or more by weight. If the fluorine containing amount in fluoroaliphatic group Rf is less than 40% by weight, the object of the invention may not be accomplished sufficiently.

The fluorine atoms are more effective in localizing at terminals of the fluoroaliphatic group Rf. Therefore, a half or more of atoms bonded to at least 3 carbon atoms located in terminal portions of fluoroaliphatic group Rf has to be fluorine atoms. As examples of such terminals sufficiently fluorinated, exemplified are $CF_3CF_2CF_2$—, $CF_3CF_2CHF$—, $CF_3CHFCF_2$—, $CHF_2CF_2CF_2$—, $CF_3CHFCHF$—, etc. and among them, $CF_3CF_2CF_2$— is the most preferable. The fluoroaliphatic group Rf is preferably, completely fluorinated like $C_nF_{2n+1}$ (n is an integer of 3 or more) or substantially fluorinated.

The number of the carbon atoms in the fluoroaliphatic group is preferably from 3 to 20, but if the number of the carbon atoms is 2 or below, the fluorine containing rate can be made higher. In such a case, however, the total amount of the fluorine atoms is insufficient, so that the effects will be weak. Though the fluorine containing rate in the copolymer may be made higher by raising the ratio of the monomers containing the fluoroaliphatic group in which the number of the carbon atoms sufficiently fluorinated is two or below, an adequate effect cannot be obtained because the fluorine atoms are not localized.

When the number of carbon atoms in the fluoroaliphatic group is 21 or greater, the copolymer loses its solubility in a solvent where the fluorine containing rate is high, and if the fluorine containing rate is low, satisfactory results will hardly be obtained due inadequate localization of the fluorine atoms.

Acrylate containing the fluoroaliphatic group according to Condition (1) is set forth in detail in specifications of U.S. Pat. No. 2,803,615, U.S. Pat. No. 2,642,416, U.S. Pat. No. 2,826,564, U.S. Pat. No. 3,102,103, U.S. Pat. No. 3,282,905, and U.S. Pat. No. 3,304,278 which are hereby incorporated by reference.

What are disclosed in U.S. Pats. No. 2,592,069, U.S. Pat. No. 2,995,542, U.S. Pat. No. 3,078,245, U.S. Pat. No. 3,081,274, U.S. Pat. No. 3,291,843, and U.S. Pat. No. 3,325,163 which are hereby incorporated by reference is exemplified as terminal ethylene unsaturated monomers containing the fluoroaliphatic group, other than the above substances, suitable to make the copolymer. An ethylene unsaturated material suitable to make terminal ethylene unsaturated monomers containing the fluoroaliphatic group is set forth in U.S. Pat. No. 3,574,791

The following compounds are exemplified as acrylates containing the fluoroaliphatic group according to Condition (1).

$C_8F_{17}SO_2N(C_4H_9)CH_2CH_2OCOCH{=}CH_2$ $C_8F_{17}SO_2N(C_3H_7)CH_2CH_2OCOCH{=}CH_2$ $C_8F_{13}SO_2N(C_4H_9)CH_2CH_2OCOCH{=}CH_2$ $C_8F_{17}SO_2N(C_2H_5)CH_2CH_2OCOCH{=}CH_2$ $C_8F_{17}CH_2CH_2OCOCH{=}CH_2$

The following compounds are exemplified as methacrylates containing the fluoroaliphatic group according to Condition (1).

$C_8F_{17}SO_2N(C_4H_9)CH_2CH_2OCOC(CH_3){=}CH_2$ $C_8F_{17}SO_2N(C_3H_7)CH_2CH_2OCOC(CH_3){=}CH_2$ $C_6F_{13}SO_2N(C_4H_9)CH_2CH_2OCOC(CH_3){=}CH_2$

For poly(oxyalkylene) acrylate or poly(oxyalkylene) methacrylate, one type monomers can be used solely or a combination of two or more types of monomers in an arbitrary ratio can be used. As a monomer according to Condition (2), not only monoacrylate and monomethacrylate but also diacrylate and dimethacrylate or the like can be used.

A polyoxyalkylene $(OR')_x$ of poly(oxyalkylene) acrylate or poly(oxyalkylene) methacrylate functions as soluble portions when copolymers are prepared. The R' of the polyoxyalkylene $(OR')_x$ denotes an alklene group having two to four carbon atoms. For example, —$CH_2CH_2$—, —$CH_2CH_2CH_2$—, —$CH(CH_3)CH_2$—, or —$CH(CH_3)CH(CH_3)$— is suitable.

The oxyalkylene unit OR' in the polyoxyalkylene can be the same as each other, or two or more oxyalkylene units different from each other can be profiled irregularly. As an example of the former, poly(oxypropylene) can be raised. As the latter, exemplified are straight or branched chain mixture of oxypropylenes and oxyethylene units, or straight or branched chain mixture of oxypropylene blocks and oxyethylene units blocks.

A polyoxyalkylene chain can be linked with one or more chain bonds and can include one or more chain bonds. As such a chain bond, —$CONHC_6H_4NHCO$— and —S— are exemplified. When a chain bond trivalent or more is included, a polyoxyalkylene chain can be a branched chain.

The poly(oxyalkylene) acrylate according to Condition (2) and other acrylate useful for manufacturing copolymers can be made by reacting materials such as Pluronic made by Asahi Denka Kogyo K.K. as a hydroxyy-poly (oxyalkylene) material available on a market, Adecapolyether made by Asahi Denka Kogyo K.K., Carbowax made by Glyco Products Co, Toriton made by Rohm and Haas Co. and P.E.G. made by Daiichi Kyogyo Seiyaku K. K. with acrylic acid, methacrylic acid, acrylchloride, or acrylic anhydride in a known manner.

To have the copolymers soluble as suitable to be used in recording materials, the molecular weight of the polyoxyalkylene chain is preferably in a range of 250 to 2500.

The following compounds are exemplified as a preferable poly(oxyalkylene) acrylate according to Condition (2).

$CH_3O(C_2H_4O)_7COCH{=}CH_2$ $HO(C_2H_4O)_6COCH{=}CH_2$ $CH_3O(C_3H_6O)_7COCH{=}CH_2$ $CH_3O(C_2H_4O)_{16}COCH{=}CH_2$

The following compounds are exemplified as a preferable poly(oxyalkylene) methacrylate according to Condition (2).

$CH_3O(C_2H_4O)_7COC(CH_3){=}CH_2$ $HO(C_2H_4O)_6COC(CH_3){=}CH_2$

The above copolymers can be made by copolymerizing, e.g., monomers according to Condition (1) and monomers according to Condition (2) under free radical initiation. The molecular weight of polyacrylate oligomers is controlled by adjusting the concentration and active degree of an initiator, the concentration of monomers, and the polymerization temperature. An addition of a chain mover (e.g., thiol, n-octyl mercaptan) may control the molecular weight of polyacrylate oligomers.

For example, a copolymer having the following repetitive units can be obtained by copolymerizing Rf-R"—$O_2C$—$CH{=}CH_2$ as acrylate containing a fluoroaliphatic group (here, R" denotes sulfonamide alkylene, carbonamide alkylene, alkylene, etc. and this formula includes $CH_8F_{17}SO_2N(C_4H_9)CH_2CH_2O_2CCH{=}CH$.) with $CH_2{=}CHO(O)(OR')_xOR$ (here R' denotes the same as above, and R denotes an alkyl group such as H or $CH_3$.) as a poly(oxyalkylene) monoacrylate.

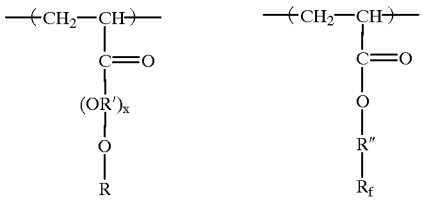

Moreover, a polyacrylate copolymer having the following repetitive units can be obtained by copolymerizing Rf-R"—$O_2C$—$CH{=}CH_2$ as acrylate containing a fluoroaliphatic group with $CH_2{=}CHCO_2(R'O)_xCOCH{=}CH_2$ (this includes $CH_2{=}CHCO_2(C_2H_4O)_{10}(C_3H_6O)_{22}(C_2H_4O)_{10}COCH{=}CH_2$ or the like.) as a poly (oxyalkylene) diacrylate which can be made by a known method.

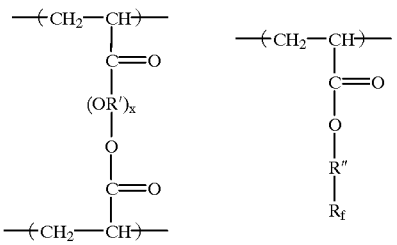

The copolymers preferably contain monomer units containing a fluoroaliphatic group according to Condition (1) of 20 to 80% by weight based on the weight of the copolymers, more preferably, contain them of 25 to 70% by weight, and, further preferably, contain them of 40 to 70% by weight. If the monomer units containing a fluoroaliphatic group are not so much, the result will be less effective, and if too much, the copolymers becomes unfavorable because the solubility to a solvent comes down so much.

The molecular weight of the copolymers to be used in the invented recording material is preferably in a range of 2,000 to 120,000 and, more preferably, in a range of 2500 to 100,000. If the molecular weight is too low, the copolymer cannot bring a sufficient effect, and if too high, the copolymers unfavorably lose their solubility to a solvent.

The copolymers used in the invented recording material preferably use the acrylate containing a fluoroaliphatic group of 50 to 100% by weight of the monomer units according to Condition (1) and use the poly(oxyalkylene) acrylate monomer units of 15% or more by weight of the entire copolymers. If the use amount of the methacrylate containing a fluoroaliphatic group is 15% or more by weight of the monomer units according to Condition (1), the copolymers loses solubility in a solvent. Particularly preferable copolymers are made by copolymerizing the acrylate containing a fluoroaliphatic group with the poly (oxyalkylene) acrylate.

For the invented recording material, the fluorine-containing surfactant is preferably used in a range of 0.01 to 5% by weight to the coloring agent and, more preferably, in a range of 0.05 to 3% by weight. When the amount of the fluorine-containing surfactant is 0.01% or less by weight, the recording material cannot have sufficient effects, and when it is 5% or more by weight, the coated film is slowly dried, and it, disadvantageously affects the Dmin of the laser exposure portions.

The fluorine-containing surfactant according to the invention is at least added to the coloring agent layer. It can be added to layers other than the coloring agent layer on a side of the coloring agent layer, such as an intermediate layer located between the support and the coloring agent layer, or an overcoat layer. It also can be added to a layer formed on the opposite face of the support to the face on which the coloring agent layer is formed.

Upon solving or dispersing the fluorine-containing surfactant in an organic solvent, the layers containing the fluorine-containing surfactant can be formed by coating them on the support.

The solvent in which the fluorine-containing surfactant is solved or dispersed preferably has its boiling temperature in a range of 40 to 200° C. and, more preferably, of 60 to 160° C. so as to be dried easily. As such a solvent, exemplified are: an alcohol such as methyl alcohol, ethyl alcohol, n- or isopropyl alcohol, n- or iso-butyl alcohol, diacetone alcohol, and so on,; a ketone such as acetone, methylethyl ketone, methylpropyl ketone, methylbutyl ketone, methylamyl ketone, methylhexyl ketone, diethyl ketone, diisobutyl ketone, cyclohexane, methyl cyclohexane, acetyl acetone, and so on; a hydrocarbon such as benzene, toluene, xylene, cyclohexane, methoxybenzene, and so on; an acetate ester such as ethyl acetate, n- or isopropyl acetate, n- or isobutyl acetate, ethylbutyl acetate, hexyl acetate, and so on; a halide such as methylene dichloride, ethylene dichloride, monochlorobenzene, and so on; an ether such as isopropyl ether, n-butyl ether, dioxane, dimethyl dioxane, tetrahydrofuran and so on; a multivalent alcohol or its derivative such as ethylene glycol, methyl cellosolve, methyl cellosolve acetate, ethyl cellosolve, diethyl cellosolve, cellosolve acetate, butyl cellosolve, butyl cellosolve acetate, methoxy ethoxy ethanol, diethylene glycol monomethyl ether, diethylene glycol dimethyl ether, diethylene glycol methylethyl ether, diethylene glycol diethyl ether, propylene glycol, propylene glycol monomethyl ether, propylene glycol monomethyl ether acetate, propylene. glycol monobutyl ether, 3-metyl-3-methoxy butanol, and so on; and a special solvent such as dimethyl sulfoxide, N,N-dimethyl formamide, and so on. Each of those solvents can used solely, and two or more types of the solvents can be used upon mixing them.

The solid concentration of the coating liquid in which the fluorine-containing surfactant is solved or dispersed in the organic solvent is properly set in a range of two to 15% by weight.

The coating liquid in which the fluorine-containing surfactant is solved or dispersed in the organic solvent is applicable onto the support by a method such as roller coating, dip coating, air knife coating, gravure coating, gravure offset coating, hopper coating, blade coating, wire doctor coating, spray coating, etc. The coating amount is preferably in a range of 10 to 100 ml/$M^2$.

After coating the coating liquid, the organic solvent is removed by drying. This drying process is generally implemented by blowing heated air. The temperature of the heated air is preferably 30 to 200° C. and, more preferably, 40 to 140° C. The drying temperature may be set at a fixed temperature during the drying process or may be raised in a stepwise manner. It is effective to blow the heated air onto the coated surface at a speed of 0.1 to 30 m/sec and, more preferably, 0.5 to 20 m/sec. Dehumidified drying air may further effectuate the drying process.

At least one coloring agent layer is provided in the recording material of the invention. A pigment, an inorganic particulate or a dye is used as a coloring agent in the coloring agent layer. Preferable pigments and inorganic particulates include carbon black, graphite, titanium black, metal phthalocyanine, metal oxides such as titanium oxide, and colloidal silver.

When using the recording material for manufacturing a printing plate, the pigment or the inorganic particulate used is required to have absorption in the UV region. When it is used for medical purposes, the pigment or the inorganic particulate used should be black in color. The particle size which gives a color of the pigment or the inorganic particulate, which largely varies with circumstances, should preferably be within a range of from 5 to 500 nm, or more preferably, from 5 to 250 nm.

The amount of coated pigment or inorganic particulate should be within a range in which the laser non-irradiated portion has absorption of a concentration of over 2.5 (absorption value in the UV region for printing purposes, and absorption value in the visible region for medical purposes). In general, the coating amount varies with the kind or size of inorganic particulate used. For example, when coating carbon black (particle size: 24 nm) in a coating amount of 0.67 g/$m^2$, there are obtained a UV concentration of 4.0 and a visible concentration of 2.7. Colloidal silver (particle size: 20 nm), if coated in a coating amount of 0.5 g/$m^2$, leads to a UV concentration of 3.5 and a visible concentration of 0.4.

Use of a pigment or an inorganic particulate having absorption in the laser wavelength region is preferable because of the simultaneous availability of two functions including a laser wavelength absorbing material and a coloring agent. More specifically, this is favorable in that the necessity of individually preparing a laser wavelength absorbing material and a coloring agent is eliminated or alleviated.

There is no particular limitation imposed on the method of manufacturing a pigment or an inorganic particulate used in the invention so far as manufacture of the foregoing particle size is permitted. For example, the channel method, the thermal method and the furnace method disclosed in Donnel Voet, "Carbon Black" Marcel Dekker, Inc. (1976) are applicable for a carbon black material.

A dye of any kind may be used for the coloring agent layer of the invention so far as it permits ablation by laser irradiation. For example, dyes disclosed in U.S. Pat. Nos. 4,541,830, 4,698,651, 4,695,287, 4,701,439, 4,757,046, 4,743,582, 4,769,360, and 4,753,922, which are hereby incorporated by reference can by appropriately applied. These dyes may be used either alone or in combination. These dyes may be used in a coating amount within a range of from about 0.05 to about 1 g/$m^2$.

The coloring agent layer side of the recording material of the invention preferably contains a coloring agent layer, an intermediate layer provided between the coloring agent layer and the support, and an overcoat layer over the coloring agent layer. Two overcoat layers may be provided. Further, a primelayer may be provided for achieving a higher close contact between the intermediate layer and the support.

Wide variety of binders may be used in the coloring agent layer side of the recording material of the invention provided that the components of the layers are dispersed in the binders. Preferable binders are decomposable polymers which are quickly pyrolized by heat generated from laser irradiation and gives a gas in a sufficient quantity and a volatile fragment, or a decomposable polymer of which the decomposition temperature considerably decreases in the present of a slight amount of an acid. Preferable ones of such decomposable polymer include those having a polystyrene equivalent molecular weight of over 100,000 as measured by size-excluded chromatography disclosed in U.S. Pat. No. 5,330,876 which is hereby incorporated by reference (F. W. Billmeyer, "Textbook of Polymer Science", 2nd ed., 53–57).

Particularly preferable binders for the coloring agent layer side of the recording material of the invention are nitric esters of carboxyalkyl cellulose and cellulose nitrate. Nitric esters of carboxyalkyl cellulose are prepared by reacting a carboxy alkylcellulose such as carboxymethyl cellulose and carboxyethyl cellulose with a mixed acid for nitric esterization comprising for example sulfuric acid, nitric acid and water to achieve a degree of nitric ester group substitution in the carboxyalyl cellulose of at least 0.2 and a degree of carboxyalkyl ether group substitution of at least 0.05. Examples of the nitric esters of carboxyalkyl cellulose include the aqueous cellulose derivatives disclosed in Japanese Unexamined Patent Publications Nos.5-39301 and 5-39302 which are hereby incorporated herein by reference.

Any layers on the coloring agent layer side provided in the laser ablative recording material of the invention may preferably contain a nitric esters of carboxyalkyl cellulose. The nitric esters of carboxyalkyl cellulose may be contained in the coloring agent layer, or in the intermediate layer present between the support and the coloring agent layer, or in the overcoat layer present on the coloring agent layer.

The nitric esters of carboxyalkyl cellulose used in the invention preferably have a degree of nitric ester group substitution within the range of from 0.2 to 2.2 and a degree of carboxyalkyl ether group substitution within the range of from 0.05 to 1.5. Adegree of nitric ester group substitution of under 0.2 is not desirable because of insufficient dispersibility and water resistance of a developer and a dye. A degree of carboxyalkyl ether group substitution of under 0.05 leads to an insufficient solubility in water, as to practical impossibility to use the same as a water-soluble binder.

A degree of nitric ester group substitution of over 2.2 is not desirable because of the necessity of increasing the consumption of an organic solvent to dissolve or disperse the same in a mixed solvent of water and an organic solvent. A degree of carboxyalkyl ether group substitution of over 1.5 tends to a slightly insufficient water resistance of the coated surface. Carboxyl group of nitric ester of carboxyalkyl cellulose used in the invention may be partially or totally neutralized. Neutralization increases solubility into water and a water-soluble organic solvent mainly comprising water. For the purpose of neutralizing the carboxyl group, one or more of an alkali metal ion, an alkali earth metal ion, ammonium ion and a cation of an organic amine or the like may be used. The extent of neutralization, depending upon the chemical composition of the target solution including water and organic solvent contents, should preferably be in general such that 50% or more of carboxyl groups are neutralized.

The amount of coated nitric ester of carboxyalkyl cellulose should preferably be within a range of from 0.05 to 5 $g/m^2$, or more preferably, of from 0.1 to 3 $g/m^2$.

In the recording material of the invention, a nitric ester of carboxyalkyl cellulose may be used either alone or in combination with at least one of known binders.

Examples of the known binders include cellulose derivatives such as carboxymethyl cellulose and hydroxyethyl cellulose, and polymers such as polyvinyl alcohol, carboxy-denatured polyvinyl alcohol, polyvinyl pyrrolidone, polyacrylic acid, polyacrylamide and gelatine, but are not limited to those enumerated above. Latex-based binders such as styrenebutadiene latex and urethane latex may also be used.

In the recording material of the invention, an overcoat layer may be provided for the purpose of imparting satisfactory scraping resistance, wear resistance and mat finish, as is disclosed in Japanese Unexamined Patent Publication No. 8-108,622 which is hereby incorporated by reference. Provision of the overcoat layer permits easy handling because of the slightest risk of discoloration of the formed image caused by finger prints or the like.

Beads may be contained in the overcoat layer. Particularly, polytetrafluoroethylene beads should preferably be contained. The particle size and the coating amount of polytetrafluoroethylene beads can be set within a range effective for achieving the intended object. In general, the particle size should preferably be within a range of from about 1 to about 100 $\mu$m, or more preferably, from about 3 to about 50 $\mu$m. The coating amount should be within a range of from about 0.005 to about 5.0 $g/m^2$, or more preferably, within a range of from about 0.05 to about 0.5 $g/m^2$. Polytetrafluoroethylene beads are not necessarily required to be in a spherical shape, but may be in any arbitrary shape.

As the binder of the overcoat layer containing beads, any arbitrary polymer may be used. More specifically, applicable polymers include cellulose derivatives such as cellulose nitrate, cellulose acetate hydrogen phthalate, cellulose acetate, cellulose acetate propionate, cellulose acetate butylate, cellulose triacetate, hydroxypropyl cellulose ether, ethyl cellulose ether, polycarbonate; polyurethane, polyester; poly(vinyl acetate); poly (vinyl halide) such as poly (vinyl chloride) and poly(vinyl chloride) copolymers; poly (vinyl ether); maleic acid anhydride copolymer; polystyrene; poly(styrene-co-acrylonitrile); polysulfon; poly (phenylene oxide); poly(ethylene oxide); poly(vinylalcohol-co-acetal) such as poly(vinyl acetal), poly(vinylacetal-co-butyral) and poly(vinylbenzal); and mixtures and copolymers thereof. The binder for the overcoat layer can be used in a coating amount within a range of from about 0.1 to about 5 $g/m^2$.

One or more layers on the coloring agent layer side provided in the laser ablative recording material of the invention should contain a material having absorption within the wavelength region of the laser to be irradiated. The material having absorption in the laser wavelength region may be contained in the coloring agent layer, or in the intermediate layer present between the support and the coloring agent layer, or in the overcoat layer present on the coloring agent layer.

When the irradiated laser is an infrared laser, the material having absorption in the laser wavelength region should be an infrared-absorbing material. The amount of coated infrared-absorbing material should have a laser wavelength absorbance of over 0.5, or preferably, over 1.0, or more preferably, over 1.5. Applicable infrared-absorbing materials include, for example, carbon black, cyanic infrared-absorbing dye disclosed in U.S. Pat. No. 4,973,572, and materials disclosed in U.S. Pat. Nos. 4,948,777, 4,950,640, 4,950,639, 4,948,776, 4,948,778, 4,942,141, 4,952,552, 5,036,040, 4,912,083, 5,360,694, 5,380,635and JPA No. 8-189,817. These patent publications are hereby incorporated by reference.

Typical examples of infrared-absorbing material suitably applicable for the laser ablative recording material of the invention are presented below. Infrared-absorbing materials applicable for the laser ablative recording material of the invention are not however limited to those enumerated below.

(1)

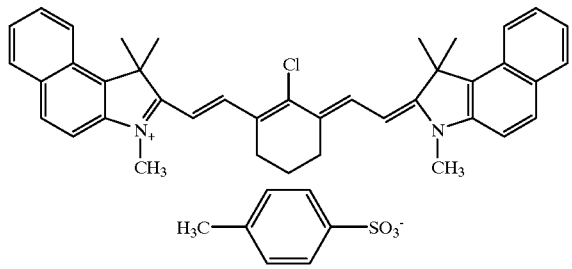

(2)

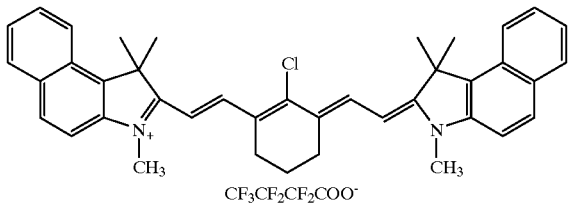

-continued (3)

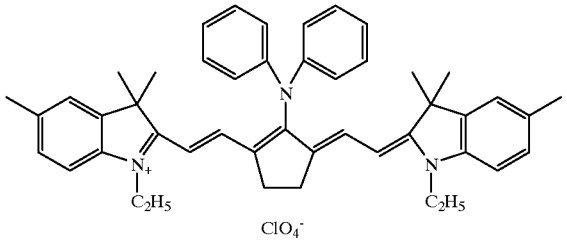

(4)

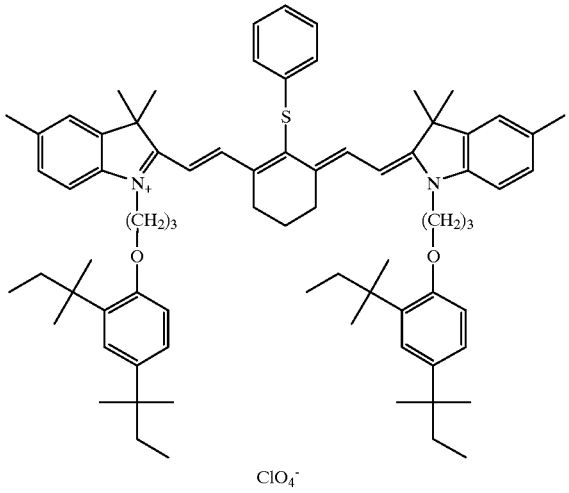

(5)

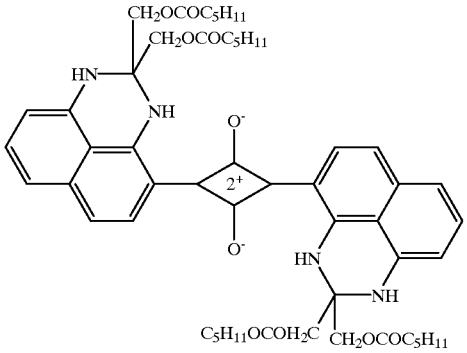

(6)

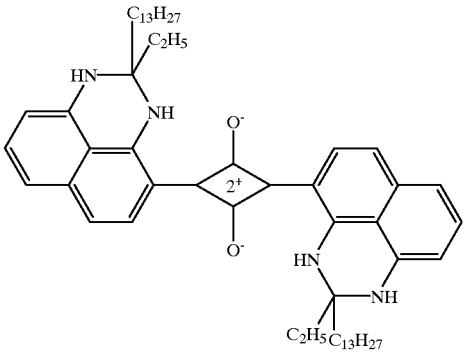

-continued (7)

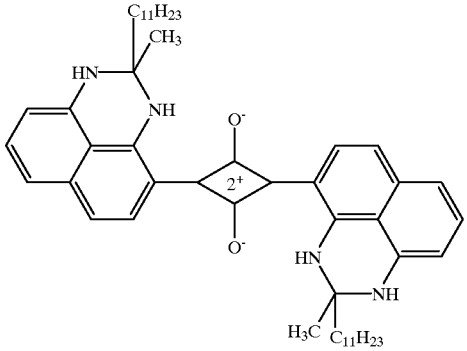

A backcoat layer may be provided in the laser ablative recording material of the invention. The backcoat layer may be formed on the surface of the support on the opposite side to the coloring agent layer.

From the point of view of adhesivity and strippability between recording materials, the outermost layer surface of the backcoat layer should preferably have a Beck smoothness of up to 4,000 seconds, or more preferably, within a range of from 10 to 4,000 seconds. Beck smoothness can be easily determined in accordance with the Japanese Industrial Standard (JIS) P8119 "Smoothness Testing Method of Paper and Cardboard by Beck Tester" and the TAPPI Standard Method T479.

Beck smoothness can be controlled by adjusting the average particle size and the quantity of addition of a matting agent to be contained in the overcoat layer of the backcoat layer. In the invention, the matting agent should preferably have an average particle size of up to 20 $\mu$m, or more preferably, within a range of from 0.4 to 10 $\mu$m. The quantity of added matting agent should preferably be within a range of from 5 to 400 mg/m$^2$, or more preferably, from 10 to 200 mg/m$^2$.

As the matting agent used in the invention, any solid particles may be used so far as they do not cause a problem in handling, and may be either inorganic or organic. Examples of inorganic matting agent include silicon dioxide, titanium and aluminum oxides, zinc and calcium carbonates, barium and calcium sulfates, and calcium and aluminum silicates. Applicable organic matting agents include organic polymers such as cellulose esters, polymethylmethacrylate, polystyrene and polydivinylbenzene and copolymers thereof.

In the invention, it is desirable to use a porous matting agent disclosed in Japanese Unexamined Patent Publication No. 3-109,542, page 2, left lower column, line 8 through page 3, right upper column, line 4, an alkali surface-modifying matting agent disclosed in Japanese Unexamined Patent Publication No. 4-127,142, page 3, right upper column, line 7 through page 5, right lower column, line 4, or an organic polymer matting agent 11 disclosed in Japanese Patent Application No. 4-265,962, paragraph Nos. [0005] to [0026]. These patent publications and application are hereby incorporated by reference.

These matting agents may be used either alone or two or more thereof in combination. Manners of simultaneous use of two or more matting agents include simultaneous use of an inorganic matting agent and an organic matting agent, simultaneous use of a porous matting agent and a non-porous matting agent, simultaneous use of an amorphous matting agent and a spherical matting agent, and simultaneous use of matting agents with different average particle sizes (for example, simultaneous use of a matting agent having an average particle size of at least 1.5 μm disclosed in Japanese Patent Application No. 4-265,962 which is hereby incorporated by reference and a matting agent having an average particle size of up to 1 μm).

A conductive layer having a surface resistance of up to $10^{12}$ Ω at 25° C. and 30% RH may be provided in the recording material of the invention. The conductive layer may be provided either on the coloring agent layer side of the support or on the backcoat layer side. A single conductive layer or two or more such layers may be provided. Further, the conductive layer may be prepared. by adding a conductive material to a layer having other functions such as a surface protecting layer, a backcoat layer or a primer layer.

The conductive layer can be formed by coating a coating solution containing a conductive metal oxide or a conductive polymeric compound.

As a conductive metal oxide, it is desirable to use crystalline metal oxide particles. Among others, a particularly preferable one is a conductive metal oxide containing an oxygen defect or containing exotic atom in a slight amount, which forms a donor to the metal oxide used, which has in general a high conductivity. Applicable metal oxides include ZnO, $TiO_2$, $SnO_2Al_2O_3$, $In_2O_3$, $SiO_2$, MgO, BaO, $MoO_3$ and $V_2O_5$ and composite oxides thereof. Particularly, ZnO, $TiO_2$ and $SnO_2$ are preferable. Effective examples containing an exotic atom include ZnO containing added Al, In or the like, $SnO_2$ containing added Sb, Nb or a halogen element, and $TiO_2$ containing added Nb, Ta or the like. The quantity of addition of the exotic atom in these cases should preferably be within a range of from 0.01 to 30 mol %, or more preferably, from 0.1 to 10 mol %.

The metal oxide particulate used in the invention should preferably be conductive and have a volume resistivity of up to $10^7$ Ω.cm, or more preferably, up to $10^5$ Ω.cm. These oxides are disclosed in Japanese Unexamined Patent Publications Nos. 56-143,431,56-120,519 and 58-62,647 which are hereby incorporated by reference.

A conductive material prepared by causing the aforesaid metal oxides to adhere to other crystalline metal oxide particles or a fibrous material (titanium oxide, for example) may also be used, as is disclosed in Japanese Examined Patent Publication No. 59-6,235 which is hereby incorporated by reference.

The conductive material used in the invention should preferably have a particle size of up to 10 μm, or more preferably, up to 2 μm with a view to ensuring stability after dispersion. In order to achieve the lowest possible light scattering, it is desirable to use conductive particles having a particles size of up to 0.5 μm. Use of such conductive particles permits maintenance of transparency of the support by providing a conductive layer.

When the conductive material is acicular-shaped or fibrous, the material should preferably have a length of up to 30 μm and a diameter of up to 2 μm, or more preferably, a length of up to 25 μm and a diameter of up to 0.5 μm, with a length/diameter ratio of at least 3.

Preferable conductive polymeric compounds applicable in the invention include polyvinyl benzenesulfonic salts, polyvinylbenziltrimethylammonium chloride, grade-4 polymers as disclosed in U.S. Pat. Nos. 4,108,802, 4,118,231, 4,126,467, and 4,137,217 which are hereby incorporated by reference, and polymer latexes as disclosed in U.S. Pat. No. 4,070,189, West German Unexamined Patent Publication No. 2,830,767, Japanese Unexamined Patent Publications Nos. 61-296,352 and 61-62,033.

Some concrete examples of the conductive polymeric compound of the invention are enumerated below. Conductive materials applicable in the invention are not however limited to those presented below. The composition of the following polymers is expressed in percentage of polymerization.

E-1

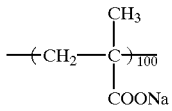

E-2

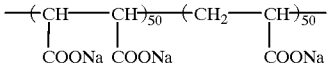

E-3

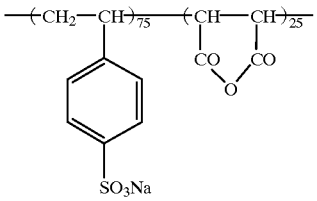

E-4

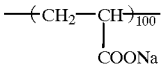

E-5

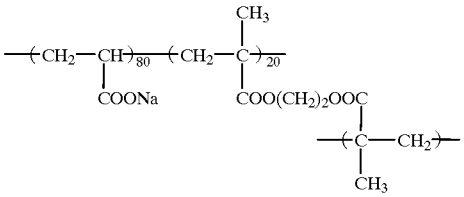

E-6

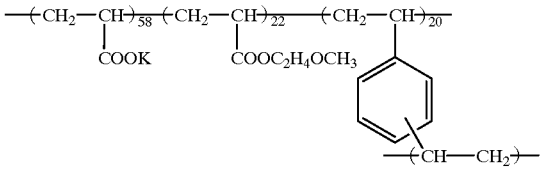

E-7

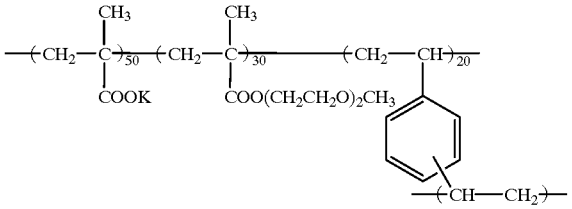

The conductive metal oxide or the conductive polymeric compound is used for forming a conductive layer after dispersing or dissolving in a binder.

The binder used for dispersing or dissolving the conductive metal oxide or the conductive polymeric compound is not particularly limited so far as a film-forming ability is available. For example, applicable binders include protein such as gelatine and casein, cellulose compounds such as carboxymethyl cellulose, hydroxyethyl cellulose, acetyl cellulose, diacetyl cellulose, and triacetyl cellulose, dextran, agar, soda alginate, saccharides such as starch derivatives, and synthetic polymers; such as polyvinyl alcohol, polyvinyl acetate, polyacrylic ester, polymethacrylic ester, polystyrene, polyacrylamide, poly-N-vinylpyrrolidone, polyester, polyvinyl chloride, and polyacrylic acid.

Particularly preferable ones include gelatine (lime-treated gelatine, acid-treated gelatine, enzyme-decomposed gelatine, phthalized gelatine, acetylated gelatine, etc.), acetylcellulose, diacetylcellulose, triacetylcellulose, polyvinyl acetate, polyvinyl alcohol, polyacrylic butyl, polyacrylamide, and dextran.

In order to effectively reduce resistance of the conductive layer, a higher volume content of the conductive metal oxide or the conductive polymeric compound is more preferable. However, a binder content of under 5% leads to a lower strength of the conductive layer, and is therefore undesirable. The volume content of the conductive metal oxide or the conductive polymeric compound should therefore preferably be set within a range of from 5 to 95%.

The consumption of the conductive metal oxide or the conductive polymeric compound per $m^2$ of the recording material of the invention should preferably be within a range of from 0.05 to 20 $g/m^2$, or more preferably, from 0.1 to 10 $g/m^2$. To impart a satisfactory antistatic property, the surface resistivity of the conductive layer should be up to $10^{12}$ Ω under conditions including 25° C. and 30% RH, or more preferably, up to $10^{11}$ Ω.

A better antistatic property can be imparted by simultaneously using a fluorine-containing surfactant in addition to the foregoing conductive material. The fluorine-containing surfactant used in the conductive layer may be the same as the above-mentioned fluorine-containing surfactant, or different therefrom. As the fluorine-containing surfactant used in the conductive layer, a surfactant may have a fluoroalkyl group, an alkenyl group or an aryl group having a carbon number of at least 4, and as an ionic group, an anion group (sulfonic acid (salt), sulfuric acid (salt), carboxylic acid (salt), phosphoric acid (salt)) a cation group (amine salt, ammonium salt, aromatic amine salt, sulfonium salt, phosphonium salt), betaine group (carboxyamine salt, carboxyammonium salt, sulfoamine salt, sulfoammonium salt, phosphoammonium salt) or a nonion group (substituted, non-substituted polyoxyalkylene group, polyglyceril group or sorbitan residue). These fluorine-containing surfactants are disclosed in Japanese Unexamined Patent Publication No. 49-10,722, British Patent No. 1,330,356, U.S. Pat. Nos. 4,335,201, 4,347,308, B.P. No. 1,417,915, Japanese Unexamined Patent Publication No. 55-149,938, 58-196,544, and B.P. No. 1,439,402 which are hereby incorporated by reference.

Examples of the fluorine-containing surfactant applicable in the conductive layer are enumerated below.

F-1

$$C_8F_{17}SO_3K$$

F-2

$$C_8F_{17}SO_2N(C_3H_7)-CH_2COOK$$

F-3

$$C_8F_{17}SO_2N(C_4H_9)-(CH_2CH_2O)_4-(CH_2)_4-SO_3Na$$

-continued

F-4

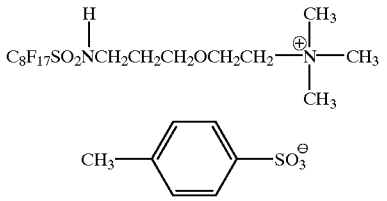

As the support in the recording material of the invention, any material may be used so far as it has a size stability and can withstand heat produced by laser irradiation. Materials applicable as a support include polyesters such as poly (ethylene naphthalate) and poly (ethylene terephthalate); polyamide; polycarbonate; cellulose esters such as cellulose acetate; fluoro-polymers such as poly(vinylidene fluoride) and poly(tetrafluoro-ethylene-co-hexafluoropropylene; polyethers such as polyoxymethylene; polyacetal; polyolefins such as plystyrene, polyethylene, polypropylene and methylpentenpolymer; and polyimides such as polyimide and polyetherimide. The thickness of the support, not particularly limited, should usually be within a range of from about 5 to about 200 μm.

As required, a primer layer as disclosed in U.S. Pat. Nos. 4,695,288 and 4,737,486, which are hereby incorporated by reference, may be coated onto the support.

An image can be recorded on the recording material of the invention in accordance with an ordinary laser ablation recording method.

In the present invention, laser irradiation is preferably accomplished from the coloring agent layer side since image forming based on the single sheet method is possible without the necessity of a receiving material.

The ablative recording material of the invention should have a Dmin of up to 0.11 after laser irradiation, as is described in Japanese Unexamined Patent Publication No. 8-48,053. With a Dmin of up to 0.11, a luster line recognizable by naked eyes is largely eliminated. In order to achieve a Dmin of up to 0.11, the laser beam intensity for writing produced by the laser diode onto the recording material should preferably be at least 0.1 $mW/\mu m^2$.

In order to form a laser ablative image on the recording material of the invention, it is desirable to use an infrared diode laser having light emission at above 700 nm. Such a diode laser has practical advantages in that it is compact in size, low in cost, has high stability and reliability, is robust and permits easy modulation.

Laser ablation recording onto the recording material of the invention can be conducted with the use of a commercially available laser irradiating apparatus. Applicable such apparatuses include the laser model SDL-2420-H2 of Spectra Diode Labs., and the laser model SLD304 V/W of Sony Corporation).

When a laser is irradiated onto the recording material of the invention, the material is partially ablated from the support and is scattered into the surrounding open air. The ablated material may gather around the laser apparatus, or accumulate on the portion written with laser. This dump shuts off the laser beam, causes Dmin to increase over the allowable level, and may thus make the image quality degraded to become impracticable. To cope with such a problem, it is desirable to simultaneously use an apparatus for removing the ablated material with an air flow. An example of such a removing apparatus is disclosed in Japanese Unexamined Patent Publication No. 8-72,400 which is hereby incorporated by reference.

A laser ablative record with an image formed by laser irradiation onto the recording material of the invention should preferably be subjected to a treatment for increasing durability of the image. For example, a protecting layer may be formed on the surface of the coloring agent layer side for the protection of the image.

The protecting layer may be formed by the use of an image protecting laminated sheet disclosed in Japanese Unexamined Patent Publication Nos. 5-504,008 and 6-344,676, which are hereby incorporated by reference. This image protecting laminated sheet has a support and a substantially transparent and wear-resistant withstanding layer (protecting layer), and the support and the withstanding layer are bonded together by a weak bonding layer formed therebetween. In application, the withstanding layer of the image protecting laminated sheet is first placed fact to face with the image of the recording material, and after bonding of the surfaces of the withstanding layer and the recording material, the support of the image protecting laminated sheet is stripped off. By doing so, a withstanding layer is formed on the surface of the recording material and plays a role of a protecting layer. Particularly, when adopting the protecting layer forming method disclosed in Japanese Unexamined Patent Publication No. 6-344,676 which is hereby incorporated by reference, the protecting layer never peels off even by repeatedly using a strong adhesive tape upon printing or repeatedly washing the image.

A typical example of the material for the protecting layer used in the invention is a polymeric organic material containing siloxane as disclosed in Japanese Unexamined Patent Publication No. 6-344,676 which is hereby incorporated by reference. A siloxane-containing polymeric material can be prepared, for example, through co-polymerization of an organic monomer or oligomer functionalized with a vinylether group and a siloxane monomer or oligomer. One prepared by any other method is also applicable. The protecting layer on the image has usually a thickness of up to 30 $\mu$m, and in order to prevent an excessive decrease in resolution, the thickness should preferably be up to 10 $\mu$m, or more preferably, within a range of from 0.5 to 6 $\mu$m.

The laser ablative record having an image formed by irradiating a laser onto the recording material of the invention may be stored or used directly for record, or used as a printing plate for printing purposes or as a film for printing. The areas of application thereof widely cover diverse and various fields including press printing, printing for facsimile output, various commercial prints, and medical images. Either a positive or a negative image may be selected and formed on the recording material of the invention in response to the purpose of use, A person skilled in the art could appropriately select a support of the recording material and a material for the coloring agent for the recording material of the invention, depending upon 2, particular object of application.

EXAMPLES

Now, the present invention will be described further in detail by means of examples. The chemical compositions, the ratios and the procedures shown in the following examples may be appropriately modified within the scope not deviating from the spirit of the present invention. The scope of the present invention is not therefore limited by the following examples.

Example 1

In this Example, recording materials using the fluorine-containing surfactant according to invention (Recording Materials 1 to 11) and a recording material using no fluorine-containing surfactant for comparison (Recording Material $\alpha$) were prepared, and surface states and Dmin were evaluated.

Each Recording Material was made by coating, on a side of a support whose surface was processed, an intermediate layer, a coloring agent layer, an overcoat layer, subsequently, on the back side of the support, first to third back coating layers subsequently. Its details are as follows:

<Surface Treatment on Support>

Both surfaces of a polyethylene terephthalate film having a thickness of 100 $\mu$m, were processed with a glow discharge. The process conditions was set at 0.2 Torr process atmosphere pressure, 40% water partial pressure in the atmospheric gas, 30 kHz discharge frequency, 2500 W output, and 0.5 kV.A.min/m$^2$.

<Formation of Intermediate Layer>

The coating liquid having the following composition was coated on one surface of the support so that the coated amount of carboxymethylcellulose nitrate solution was 0.25 g/m$^2$.

TABLE 1

Composition of the Coating Liquid for Forming Intermediate Layer

| Component | Part by Weight |
|---|---|
| Carboxymethylcellulose nitrate solution* | 4.8 |
| Acetone | 11.8 |
| Methanol | 5.9 |
| Water | 7.4 |

*15% solution of carboxymethylcellulose nitrate (substitution degree of nitrate group per glucose anhydride unit was 2.1; substitution degree of carboxymethyether group per the same was 0.7; solvent was a mixture solvent of acetone, methanol, and water (40:20:25, ratio by weight); the pH of the solution is controlled at 6.9 in use of aqueous ammonia.)

<Formation of Coloring Agent Layer>

A coating liquid for forming a coloring agent layer was prepared by uniformly dispersing a mixture having the following composition. This coating liquid was coated on the intermediate layer by a rod coater method so that the coated amount of the carbon black was 0.5 g/m$^2$.

TABLE 2

Composition of the Coating Liquid for Forming Coloring Agent Layer

| Component | Part by Weight |
|---|---|
| Cellulose nitrate (RS 1/8 sec, Daiseru Kagaku Co.) | 5 |
| SORSPERSE S2000 (Zeneka Co.) | 1.35 |
| SORSPERSE S1200 (Zeneka Co.) | 0.23 |
| Carbon black (particle size 23 nm, oil absorption amount 66 ml/100 g) | 5 |
| Fluorine-containing Surfactant (see Table 3) | See Table 3 |
| Isopropyl alcohol | 2.14 |
| Methyl isobutyl ketone | 26.6 |
| Methyl ethyl ketone | 62.0 |

TABLE 3

Composition of Fluorine-containing Surfactant and Use amount

| Recording Material No. | Weight Ratio of Monomers A | B1 | B2 | B3 | Molecular Weight | Part By Weight |
|---|---|---|---|---|---|---|
| Recording material α | — | — | — | — | — | 0 |
| Recording material 1 | 40 | 60 | — | — | 15,000 | 0.05 |
| Recording material 2 | 40 | 60 | — | — | 15,000 | 0.15 |
| Recording material 3 | 40 | 60 | — | — | 15,000 | 0.30 |
| Recording material 4 | 60 | — | 40 | — | 15,000 | 0.05 |
| Recording material 5 | 60 | — | — | 40 | 15,000 | 0.05 |
| Recording material 6 | 60 | — | 40 | — | 5,000 | 0.05 |
| Recording material 7 | 60 | — | 40 | — | 50,000 | 0.05 |
| Recording material 8 | 20 | — | 80 | — | 15,000 | 0.05 |
| Recording material 9 | 80 | — | 20 | — | 15,000 | 0.05 |
| Recording material 10 | 60 | — | 40 | — | 2,000 | 0.05 |
| Recording material 11 | 60 | — | 40 | — | 120,000 | 0.05 |

Note: structural formulas of monomers
A: $C_8F_{17}SO_2N(C_3H_7)CH_2CH_2OCOCH{=}CH_2$
B1: $HO(C_2H_4O)_6COCH{=}CH_2$
B2: $CH_3O(C_2H_4O)_7COCH{=}CH_2$
B3: $CH_3O(C_2H_4O)_7COC(CH_3){=}CH_2$ <Formation of Overcoat Layer>

A cyclohexane solution containing the following component was coated on the coloring agent layer so that the coated amount of the polymethylmethacrylate was 0.25 g/m$^2$.

TABLE 4

Composition of the Coating Liquid for Forming Overcoat Layer

| Component | Part by Weight |
|---|---|
| Polymethylmethacrylate | 0.25 |
| Polytetrafluoroethylene beads** | 0.1 |
| FLOREN TG710 (made by Kyoeishya Kagaku) | 0.03 |

**Zonyl TLP-10F-1; made by Dupont, particle size: 0.2 μm

<Formation of First Back Coat Layer (conductive layer)>

A hydrated stannic chloride 230 g and an antimony trichloride 23 g were dissolved in 3,000 g ethanol to prepare a uniform solution.

To this solution, 1N sodium hydroxide aqueous solution was dropped to adjust the pH to 3, thereby forming a co-precipitate of colloidal stannic oxide and antimony oxide. The resultant co-precipitate was held at 50° C. for 24 hours and a red-brown colloidal precipitate was obtained. The red-brown colloidal precipitate was then separated by a centrifugal separation methol, and excess ions were removed by rinsing manipulations repeated three times in which water was added for centrifugal separation.

Subsequently, 200 g colloidal precipitate from which excess ions were removed was dispersed again in 1,500 g water. The resultant dispersion solution was sprayed onto a baking oven heated to 500° C., thereby obtaining bluish micro powder of stannic oxide-antimony oxide composite mixture. The micro powder had an average particle size of 0.005μm and a resistivity of 25 Ω.cm. A mixed solution of 40 g obtained fine powder and 60 g water was adjusted to pH 7.0, and roughly dispersed by means of a stirrer. Then, the solution was dispersed in a horizontal type sand mill (Dynomill, made by Willy A. Backfen AG.) for a retention time of 30 minutes, thus preparing a dispersed solution in which primary particles partially aggregated as a secondary aggregate (its average particle size is 0.05 μm).

A coating liquid for forming a first back coat layer having the following composition was prepared using the dispersed liquid of conductive fine particles thus obtained. The coating liquid for forming the first back coat layer was coated on a side of the support opposite to the side on which the coloring agent layer was formed so that a dried film thickness becomes 0.3 μm and was dried for 30 seconds at 110° C.

TABLE 5

Composition of Coating Liquid for Forming First Back Coat Layer

| Component | Part by Weight |
|---|---|
| Dispersed solution of conductive particles | 160 |
| Calcified gelatin (100 ppm $Ca^{2+}$ concentration) | 10 |
| Resorcin | 20 |
| Poly oxyethyleneonylphenylether (degree of polymerization: 10) | 0.1 |
| Water | 270 |
| Methanol | 600 |

<Formation of Second Back Coat Layer>

A coating liquid for forming a second back coat layer having the following composition was coated on the first back coat layer so that a dried film thickness becomes 1.2μm and was dried at 110° C.

TABLE 6

Composition of Coating Liquid for Forming Second Back Coat Layer

| Component | Part by Weight |
|---|---|
| Diacetyl cellulose | 100 |
| Trimethylolpropane-3-toluenediisocyanate | 25 |
| Cross-link type polymer mat agent*** | 2 |
| Methyl ethyl ketone | 1050 |
| Cyclohexanone | 1050 |

***copolymer methylmethacrylate:divinylbenzene = 9:1, average particle size is 3.5 μm.

<Formation of Third Back Coat Layer>

The following components of Liquid #1 were mixed and solved by raising their temperature at 90° C. The obtained liquid was added to Liquid #2 having the following composition. The mixture was dispersed by a high pressure homogenizer, thereby creating a coating liquid for forming a third back coat layer. The coating liquid for forming a third back coat layer was coated on the second back coat layer so that the coating amount becomes 10 ml/m$^2$.

TABLE 7

Composition of Coating Liquid for Forming Second Back Coat Layer

| Component | Part by Weight |
|---|---|
| (Liquid #1) | |
| Lubricant: $C_6H_{13}CH(OH)(CH_2)_{10}COOC_{40}H_{61}$ | 0.7 |
| Lubricant: n-$C_{17}H_{35}COOC_{40}H_{81\text{-}n}$ | 1.1 |
| Xylene | 2.5 |

TABLE 7-continued

| Composition of Coating Liquid for Forming Second Back Coat Layer | |
|---|---|
| Component | Part by Weight |
| (Liquid #2) | |
| Propyleneglycolmonomethylether | 34.0 |
| Diacetyl cellulose | 3.0 |
| Acetone | 600.0 |
| Cyclohexanone | 350.0 |

<Evaluation of Surface state and Dmin>

The surface states on the coloring agent layer sides of Recording Material α and Recording Materials 1 to 11 made by the above methods were evaluated and the Dmin was measured.

The surface state was graded based on an observation through naked eyes with the following standard as shown in Table 8.

TABLE 8

| Grading Standard of Surface State | |
|---|---|
| Grade | State |
| A | Uniform |
| B | Slightly uneven |
| C | Uneven due to drying air, etc. |
| D | Remarkably uneven due to drying air, etc. |

The Dmin was measured by the following method in use of an apparatus of the same type as an image exposure apparatus set forth in Japanese Unexamined Patent Publication (KOKAI) No. Heisei 8-48,053.

Each Recording Material was set on a drum of the image exposure apparatus so that the coloring agent layer oriented outward. A laser beam was irradiated under conditions of the laser beam wavelength range of 830 to 840 nm, the official output of 550 mW on the film surface, and the spot size of 25μm. The exposure was controlled by changing the speed of the drum. A laser diode mounted on a movable stage was moved with a speed rendering a distance between beam centers of 10 μm.

While the laser beam irradiated, substances ablated from a laser beam irradiated surface were effectively removed by blowing air in use of an apparatus of the same type as an reduced pressure collector set forth in Japanese Unexamined Patent Publication (KOKAI) No. Heisei 8-72,400.

After the exposure, UV-Dmin in the exposed regions was measured at five portions by means of a densitometer TD904 (made by Macbeth Co.) using a UV filter, and was recorded as a maximum Dmin. The results were as shown in the table below.

TABLE 9

| Test Results | | |
|---|---|---|
| No. | Surface State Grade | Dmin |
| Recording material α | D | 0.22 |
| Recording material 1 | A | 0.08 |
| Recording material 2 | A | 0.08 |
| Recording material 3 | A | 0.10 |
| Recording material 4 | A | 0.08 |
| Recording material 5 | A | 0.08 |
| Recording material 6 | A | 0.10 |
| Recording material 7 | A | 0.08 |

TABLE 9-continued

| Test Results | | |
|---|---|---|
| No. | Surface State Grade | Dmin |
| Recording material 8 | B | 0.12 |
| Recording material 9 | B | 0.13 |
| Recording material 10 | B | 0.12 |
| Recording material 11 | B | 0.14 |

From these graded results, it turned out that the invented Recording Materials 1 to 11 using the fluorine-containing surfactant had a uniform surface and low Dmin.

When the invented Recording Materials 1 to 11 were printed on PS plates, which were subject to printing, the plates were confirmed as sufficiently durable.

A Recording Material β for comparison was made in which the fluorine-containing surfactant in the coloring agent layer was Zonyl FSN(registered trademark, made by Dupont, used in Japanese Unexamined Patent Publication (KOKAI) No. Heisei 7-149,065) of 0.05 part by weight having the following structure. When the coated surface state was observed by naked eyes, remarkable unevenness was found, and Recording Material β was judged as having low practicability.

$$F(CF_2CF_2)_xCH_2CH_2O(CH_2CH_2O)_yH$$

X=1 to 9, y=0 to 25.

Example 2

In this Example, a recording material including titanium black as inorganic fine particles was produced and evaluated.

That is, the carbon black used in the coloring agent layer of Recording Material α and Recording Materials 1 to 5 in Example 1 was replaced with Titanium Black 12S (made by Mitsubishi Material K.K., particle size 58 nm), thereby producing Recording Material γ and Recording Materials 12 to 16.

When those were evaluated in substantially the same way as in Example 1, the invented Recording Materials 12 to 16 had a good surface and low Dmin. To the contrary, Recording Material γ had an uneven surface and high Dmin.

Example 3

In this Example, recording materials for making plates were produced and evaluated.

<Surface Process of Support>

An aluminum support having a thickness of 300 μm was degreased by passing it through a 10% solution of sodium phosphate (III) maintained at 80° C. for one minute. The surface of the support was sandblasted by means of a nylon blush and 400 mesh pumice-aqueous emulsion and rinsed adequately by water. The support was etched by dipping it in a 25% sodium hydroxyide solution at 45° C. for nine seconds, dipped in a 20% nitric acid for 20 seconds after rinsing, and rinsed. The etched amount of the sandblasted surface was about 8 g/m$^2$ at that time. After a direct current anodic oxidizing film of 3 g/m$^2$ at a current density 15A/dm$^2$ was formed on the support surface using a 7% sulfuric acid electrolyte, it was rinsed and dried.

On one side of the support, coated were an intermediate layer, a coloring agent layer, and an overcoat layer, sequentially. The compositions of respective coating liquids for forming respective layers and coating amounts were the same as in Example 1. However, the compositions of the fluorine-containing surfactants in the coloring agent layer and use amounts were changed as shown in the following table.

TABLE 10

Composition of Fluorine-containing Surfactant and Use amount

| No. | Weight Ratio of Monomers A | B1 | B2 | Molecular Weight | Part By Weight |
|---|---|---|---|---|---|
| Recording material δ | — | — | — | — | 0 |
| Recording material 17 | 40 | 60 | — | 15,000 | 0.05 |
| Recording material 18 | 40 | — | 60 | 15,000 | 0.05 |

Note: structural formulas of monomers
A: $C_8F_{17}SO_2N(C_3H_7)CH_2CH_2OCOCH{=}CH_2$
B1: $HO(C_2H_4O)_6COCH{=}CH_2$
B2: $CH_3O(C_2H_4O)_7COCH{=}CH_2$ When the surface state of Recording Material δ was observed by naked eyes, considerable unevenness due to drying air was found. To the contrary, Recording Materials 17, 18 according to the invention using the fluorine-containing surfactants had very good surface states respectively and a uniform film thickness.

Those three Recording Materials were printed using the original film of Recording Material 1 of Example 1 and used for printing. As a result, Recording Materials 17, 18 according to the invention were found significantly durable against printing in comparison with Recording Material δ.

What is claimed is:

1. A laser ablative recording material having on a support a coloring agent layer containing a fluorine-containing surfactant and an overcoat layer formed over the coloring agent layer;

the coloring agent layer having dispersed therein inorganic fine particles as a coloring agent;

the fluorine-containing surfactant being contained in the coloring agent layer in an amount of 0.05 to 3% by weight of the amount of the coloring agent; and the fluorine-containing surfactant being a copolymer made of:

(Condition I) either or both of an acrylate having a fluoroaliphatic group and a methacrylate having a fluoroaliphatic group wherein the aliphatic group includes 3 to 20 carbon atoms and fluorine atoms of 40% or more by weight; and wherein half or above of atoms bonded to three carbon atoms constituting terminal portions are fluorine atoms; and (Condition II) either or both of a poly(oxyalkylene) acrylate and a poly(oxyalkylene) methacrylate;

wherein monomer units according to Condition I constitute 20 to 80 percent by weight of the copolymer.

2. The laser ablative recording material according to claim 1, wherein the monomer units according to Condition I are 40 to 70% by weight of the copolymer.

3. The laser ablative recording material according to claim 1, wherein the number of the carbon atoms of the fluoroaliphatic group of the monomer units according to Condition I is 6 to 12.

4. The laser ablative recording material according to claim 1, wherein the fluoroaliphatic group of the monomer units according to Condition I contains 40% or more by weight of fluorine.

5. The laser ablative recording material according to claim 4, wherein the fluoroaliphatic group of the monomer units according to Condition I contains 50% or more by weight of fluorine.

6. The laser ablative recording material according to claim 1, wherein the fluoroaliphatic group of the monomer units according to Condition I has a structural formula selected from a group of $—CF_3CF_2CF_2—$, $CF_3CF_2CHF—$, $CF_3CHFCF_2—$, $CHF_2CF_2CF_2—$, and $—CF_3CHFCHF—$.

7. The laser ablative recording material according to claim 1, wherein the fluoroaliphatic group of the monomer units according to Condition I contains a fluoroalkyl group represented by $C_nF_{2N+1}$ (n denotes an integer as 3 or above).

8. The laser ablative recording material according to claim 1, wherein the acrylate and/or methacrylate according to Condition I is selected from a group constituted of $C_8F_{17}SO_2N(C_4H_9)CH_2CH_2OCOCH{=}CH_2$, $C_8F_{17}SO_2N(C_3H_7)CH_2CH_2OCOCH{=}CH_2$, $C_6F_{13}SO_2N(C_4H_9)CH_2CH_2OCOCH{=}CH_2$, $C_8F_{17}SO_2N(C_2H_5)CH_2CH_2OCOCH{=}CH_2$, $C_8F_{17}CH_2CH_2OCOCH{=}CH_2$, $C_8F_{17}SO_2N(C_4H_9)CH_2CH_2OCOC(CH_3){=}CH_2$, $C_8F_{17}SO_2N(C_3H_7)CH_2CH_2OCOC(CH_3){=}CH_2$, and $C_6F_{13}SO_2N(C_4H_9)CH_2CH_2OCOC(CH_3){=}CH_2$.

9. The laser ablative recording material according to claim 1, wherein the acrylate and/or methacrylate according to Condition II is selected from a group constituted of $CH_3O(C_2H_4O)_7COCH{=}CH_2$, $HO(C_2H_4O)_6COCH{=}CH_2$, $CH_3O(C_3H_6O)_7COCH{=}CH_2$, $CH_3O(C_2H_4O)_{16}COCH{=}CH_2$, $CH_3O(C_2H_4O)_7COC(CH_3){=}CH_2$, and $HO(C_2H_4O)_6COC(CH_3){=}CH_2$.

10. The laser ablative recording material according to claim 1, wherein the support has a back coat layer on the surface of the support opposing to the surface on which the coloring agent layer is formed.

11. The laser ablative recording material according to claim 10, wherein the Beck smoothness of the topmost layer surface of the back coat layer is 4,000 seconds or less.

12. The laser ablative recording material according to claim 1, wherein the overcoat layer contains polytetrafluoroethylene beads.

13. The laser ablative recording material according to claim 1, wherein the overcoat layer contains substances absorptive at laser wavelength regions.

14. The laser ablative recording material according to claim 1, further comprising an intermediate layer located between the support and the coloring agent layer.

15. The laser ablative recording material according to claim 14, wherein the intermediate layer contains substances absorptive at laser wavelength regions.

16. The laser ablative recording material according to claim 1, wherein the inorganic fine particles are carbon black or titanium black.

17. A laser ablative image-formed record prepared by irradiating a laser onto the laser ablative recording material according to claim 1.

18. The laser ablative image-formed record according to claim 17, which is prepared by providing a protection layer on a surface on the coloring agent layer side after laser irradiation.

* * * * *